US009616671B2

(12) United States Patent
Koizumi et al.

(10) Patent No.: US 9,616,671 B2
(45) Date of Patent: Apr. 11, 2017

(54) CARTRIDGE

(71) Applicant: SEIKO EPSON CORPORATION, Tokyo (JP)

(72) Inventors: Yoshihiro Koizumi, Nagano (JP); Masaru Kumagai, Nagano (JP); Hitoshi Matsumoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/079,254

(22) Filed: Mar. 24, 2016

(65) Prior Publication Data

US 2016/0288511 A1 Oct. 6, 2016

(30) Foreign Application Priority Data

Mar. 30, 2015 (JP) ..... 2015-068255

(51) Int. Cl.
*B41J 2/175* (2006.01)

(52) U.S. Cl.
CPC ..... *B41J 2/1752* (2013.01); *B41J 2/175* (2013.01); *B41J 2/17513* (2013.01); *B41J 2/17553* (2013.01); *B41J 2002/17516* (2013.01)

(58) Field of Classification Search
CPC ... B41J 2/17556; B41J 2/17513; B41J 2/1752
See application file for complete search history.

(56) References Cited

U.S. PATENT DOCUMENTS 5,157,421 A * 10/1992 Kitahara ..... B41J 2/1721 347/36
6,151,052 A * 11/2000 Yang ..... B41J 2/17503 347/87
2005/0237368 A1 10/2005 Matsumoto
2006/0055749 A1* 3/2006 Schuster ..... B41J 2/17513 347/86
2007/0040874 A1 2/2007 Matsumoto
2011/0018948 A1* 1/2011 Justice ..... B41J 2/175 347/86

FOREIGN PATENT DOCUMENTS

JP 2005-035025 A 2/2005
JP 2005-254565 A 9/2005
JP 2006-027617 A 2/2006
JP 2007-076360 A 3/2007

* cited by examiner

*Primary Examiner* — Julian Huffman
(74) *Attorney, Agent, or Firm* — Global IP Counselors, LLP

(57) ABSTRACT

An object is to provide a cartridge that is configured to be readily mountable and stir a liquid contained in the cartridge. A cartridge includes an ink pack, a first air bag and a casing provided to place the ink pack and the first air bag therein. The casing has an ink supply port, an air flow port for first air bag and an air flow port for casing that are provided on a front face of the casing in a mounting direction so that this configuration enables the cartridge to be readily mounted to the inkjet printer. The pressurized air is introduced through the air flow port for first air bag into the first air bag. This expands the first air bag to press the ink pack and thereby stir ink I contained in the ink pack.

16 Claims, 5 Drawing Sheets

CARTRIDGE

CROSS-REFERENCE TO RELATED APPLICATIONS

The present application claims priority from Japanese patent application P2015-068255 filed on Mar. 30, 2015, the entirety of disclosure of which is hereby incorporated by reference into this application.

BACKGROUND

Field

The present invention relates to a cartridge that is mounted to a liquid ejection apparatus such as a printer and is configured to supply a liquid such as pigment ink.

Related Art

Pigment ink includes particles of pigment dispersed in a solvent. The pigment ink contained in an ink pack (liquid container assembly) is thus likely to cause concentration unevenness that the concentration of the pigment is lower on an upper side and higher on a lower side, due to sedimentation of the pigment. Using the pigment ink of such concentration unevenness supplied to an inkjet printer for printing is likely to cause the density unevenness in printing and deteriorate the printing quality.

A cartridge equipped with a mechanism for stirring the pigment ink contained in an ink pack has been proposed, in order to avoid such deterioration of the printing quality. A cartridge disclosed in JP 2005-35025A has an ink pack including a flexible liquid container configured to contain ink therein, a flexible air bag having the shape restorability, and a casing configured to place the ink pack and the air bag therein. The casing is in a flat rectangular parallelepiped shape having a longer dimension in a mounting direction and a shorter dimension in a width direction perpendicular to the mounting direction. The air bag is placed in a location adjacent to the ink pack in the width direction. An ink supply port is provided in a front face of the casing in the mounting direction to supply the pigment ink from the ink pack to outside. An air flow port is also provided in the front face of the casing to introduce the air into the casing and communicate the casing with the atmosphere. An air communicating port is provided in a side face of the casing to communicate the air bag with the atmosphere.

In the process of supplying the pigment ink to a printer, for example, during a printing operation, the pressurized air is introduced through the air flow port into the casing. This causes the ink pack to be pressurized from outside and thereby causes the pigment ink contained in the ink pack to be supplied through the ink supply port toward the printer. When the pressurized air is introduced into the casing, the air bag is compressed by the pressure of the pressurized air. On completion of the supply of the pigment ink to the printer, inside of the casing is open to the atmosphere via the air flow port. When the casing is open to the atmosphere, the internal pressure of the casing is decreased. The air bag is accordingly expanded to the original shape by the shape restorability. In the course of restoring the air bag to the original shape, the air bag presses the ink pack to deform the ink pack. This stirs the pigment ink contained in the ink pack and reduces the concentration unevenness of the pigment ink in the ink pack.

Introducing the pressurized air into the air bag described in JP 2005-35025A enables the air bag to be actively expanded by the pressurized air. This configuration causes the ink pack to be actively pressed by the air bag and thereby stirs the pigment ink contained in the ink pack. For the purpose of introducing the pressurized air into the air bag, there is a need to connect the air bag with a compressed air supply mechanism provided in the inkjet printer when the cartridge is mounted to the inkjet printer.

SUMMARY

By taking into account the problems described above, an object of the invention is to provide a cartridge that is configured to be readily mountable to a liquid ejection apparatus and stir a liquid contained in the cartridge.

In order to solve at least part of the above problems, according to one aspect of the invention, there is provided a cartridge that is mounted to a liquid ejection apparatus to supply a liquid. The cartridge comprises a liquid container assembly including a liquid container that is at least partly flexible and is configured to contain the liquid; a pressing assembly including a vessel that is at least partly flexible and is configured to come into contact with the liquid container; and a casing that is configured to place the liquid container assembly and the pressing assembly therein. A liquid supply port configured to supply the liquid from the liquid container assembly to outside, a fluid flow port for pressing assembly configured to introduce a fluid into the vessel and communicate the vessel with the atmosphere, and a fluid flow port for casing configured to introduce the fluid into the casing and communicate the casing with the atmosphere are provided on a front face of the casing in a mounting direction.

In the cartridge of the above aspect, in the process of supplying the liquid to the liquid ejection apparatus, the fluid is introduced into the casing through the fluid flow port for casing. The flexible liquid container assembly is accordingly pressurized from outside. The liquid contained in the liquid container assembly is accordingly supplied through the liquid supply port toward the liquid ejection apparatus. On completion of the supply of the liquid to the liquid ejection apparatus, inside of the casing is open to the atmosphere via the fluid flow port for casing. In response to a need for stirring the liquid contained in the liquid container assembly, the fluid is introduced through the fluid flow port for pressing assembly into the vessel. The introduction of the fluids expands the vessel of the pressing assembly to press the liquid container. This deforms the liquid container and thereby stirs the liquid contained in the liquid container. The fluid flow port for pressing assembly, as well as the liquid supply port and the fluid flow port for casing are provided on the front face of the casing. This configuration enables the liquid supply port to be readily connected with a liquid feed port provided in the liquid ejection apparatus in the process of mounting the cartridge to the liquid ejection apparatus and also enables the fluid flow port for pressing assembly and the fluid flow port for casing to be readily connected with a fluid supply mechanism provided in the liquid ejection apparatus.

The cartridge of the above aspect may further comprise positioning structures that are provided on respective sides on the front face of the casing such as to place the liquid supply port, the fluid flow port for pressing assembly and the fluid flow port for casing therebetween and are configured to position the casing in a mounting process. This configuration further facilitates the connection of the liquid supply port with the liquid feed port provided in the liquid ejection apparatus. This configuration also further facilitates the connection of the fluid flow port for pressing assembly and the fluid flow port for casing with the fluid supply mechanism provided in the liquid ejection apparatus.

In the cartridge of the above aspect, the pressing assembly may include a plurality of pressing assemblies, and a plurality of the fluid flow ports for pressing assemblies may be provided corresponding to the respective pressing assemblies on the front face. This configuration enables the fluid to be introduced to the respective pressing assemblies at independent timings and thereby enables the respective pressing assemblies to press the liquid container at different timings. This configuration thus enables the liquid contained in the liquid container to be sufficiently stirred by the pressing assemblies.

In the cartridge of the above aspect, the liquid container may include a front liquid container portion that is located on a front side in the mounting direction, a rear liquid container portion that is located on a rear side, and a communicating portion that is arranged to communicate the front liquid container portion with the rear liquid container portion. The communicating portion may be arranged to communicate a lower end portion of the front liquid container portion with a lower end portion of the rear liquid container portion in a mounting attitude. When the front liquid container portion is pressed by the pressing assembly, this configuration causes the ink to move in the front liquid container portion. This results in stirring the liquid in the front liquid container portion. When the front liquid container portion is pressed by the pressing assembly, the liquid also moves from the front liquid container portion through the communicating portion to the rear liquid container portion to generate a convection flow in the rear liquid container portion. This results in sufficiently stirring the liquid in the rear liquid container portion. When the rear liquid container portion is pressed by the pressing assembly, on the other hand, this configuration causes the ink to move in the rear liquid container portion. This results in stirring the liquid in the rear liquid container portion. When the rear liquid container portion is pressed by the pressing assembly, the liquid also moves from the rear liquid container portion through the communicating portion to the front liquid container portion to generate a convection flow in the front liquid container portion. This results in sufficiently stirring the liquid in the front liquid container portion.

In the cartridge of the above aspect, the liquid container may be inclined downward toward front in the mounting direction in a mounting attitude. The vessel may be configured to come in contact with a front portion of the liquid container in the mounting direction. When the liquid contains a sediment component, the sediment component precipitates in a lower portion of the liquid container assembly in the mounting attitude. The configuration that a front portion (lower portion) of the inclined liquid container is pressed by the pressing assembly enables the liquid to be stirred in the portion where the sediment component is likely to be accumulated. This thus effectively eliminates the concentration unevenness of the liquid.

In the cartridge of the above aspect, the liquid container assembly may comprise a container-side liquid supply tube that is provided in a front end portion of the liquid container assembly in the mounting direction to supply the liquid from the liquid container to outside. The container-side liquid supply tube may be connected with the liquid supply port such that an axis line of the container-side liquid supply tube faces in the mounting direction. The vessel may be placed between the liquid container and an inner wall surface portion of the casing that faces in a perpendicular direction that is perpendicular to the mounting direction. A dimension in width of the vessel in the perpendicular direction in a state that a volume of the vessel is maximized by introduction of the fluid may be equal to or less than a distance between the inner wall surface portion and the axis line. This configuration suppresses an excessive displacement of the liquid container relative to the liquid supply tube when the pressing assembly is expanded to deform the liquid container. This accordingly prevents leakage of the liquid from between the liquid container and the liquid supply tube.

In the cartridge of the above aspect, the pressing assembly may comprise an expansion width control member that is placed in the vessel and is configured to interfere with the vessel and control a maximum width of expansion when the vessel is expanded. This prevents the pressing assembly from being excessively expanded and thereby suppresses an excessive displacement of the liquid container relative to the liquid supply tube when the pressing assembly deforms the liquid container. This accordingly prevents leakage of the liquid from between the liquid container and the liquid supply tube.

The cartridge of the above aspect may further comprise an expansion width control mechanism that is configured to control an expansion width of the vessel. The liquid container assembly may comprise a container-side liquid supply tube provided in a front end portion of the liquid container assembly in the mounting direction to supply the liquid from the liquid container to outside. The container-side liquid supply tube may be connected with the liquid supply port such that an axial line of the container-side liquid supply tube faces in the mounting direction. The vessel may be placed in a location adjacent to the liquid container in a perpendicular direction perpendicular to the mounting direction. The expansion width control mechanism may comprise a plate member that is attached to a portion of the vessel opposed to the liquid container, and a protrusion that is protruded inward from the casing to come in contact with the plate member from a liquid container side. This configuration prevents the pressing assembly from being excessively expanded toward the liquid container assembly and accordingly suppresses an excessive displacement of the liquid container relative to the liquid supply tube when the pressing assembly deforms the liquid container. This accordingly prevents leakage of the liquid from between the liquid container and the liquid supply tube.

BRIEF DESCRIPTION OF THE DRAWINGS

FIG. 1A is a perspective view illustrating a cartridge which the invention is applied to;

FIG. 1B is a front view illustrating the cartridge which the invention is applied to;

DESCRIPTION OF THE EMBODIMENTS

The following describes a cartridge according to an embodiment of the invention.

(General Configuration of Cartridge)

Figure 1A:
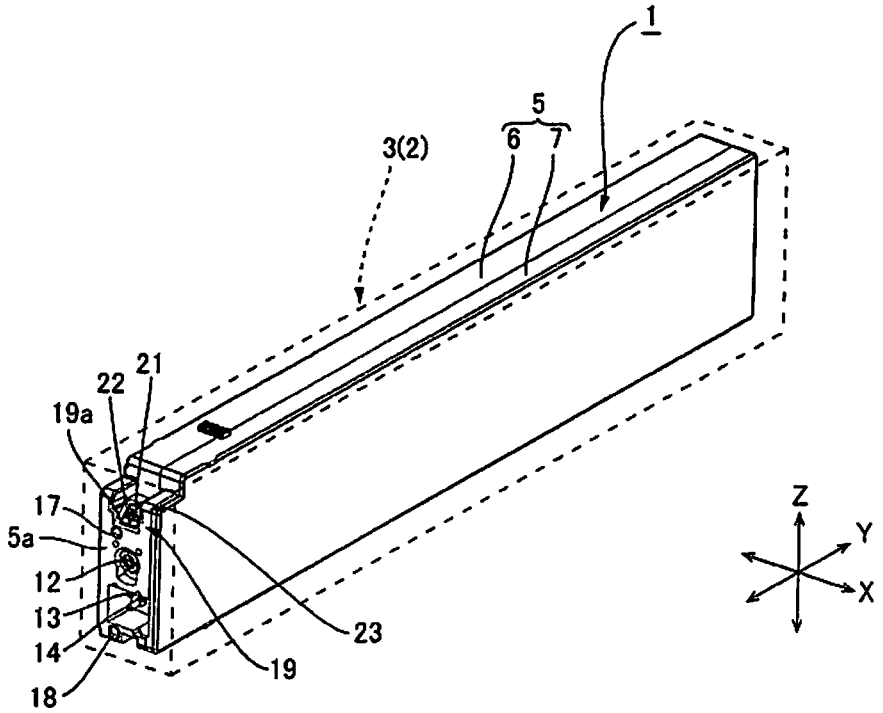
Figure 1B:
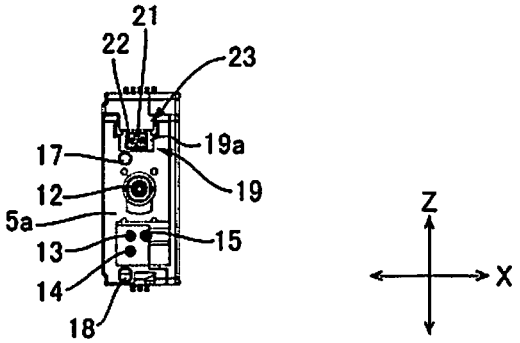
Figure 2A:
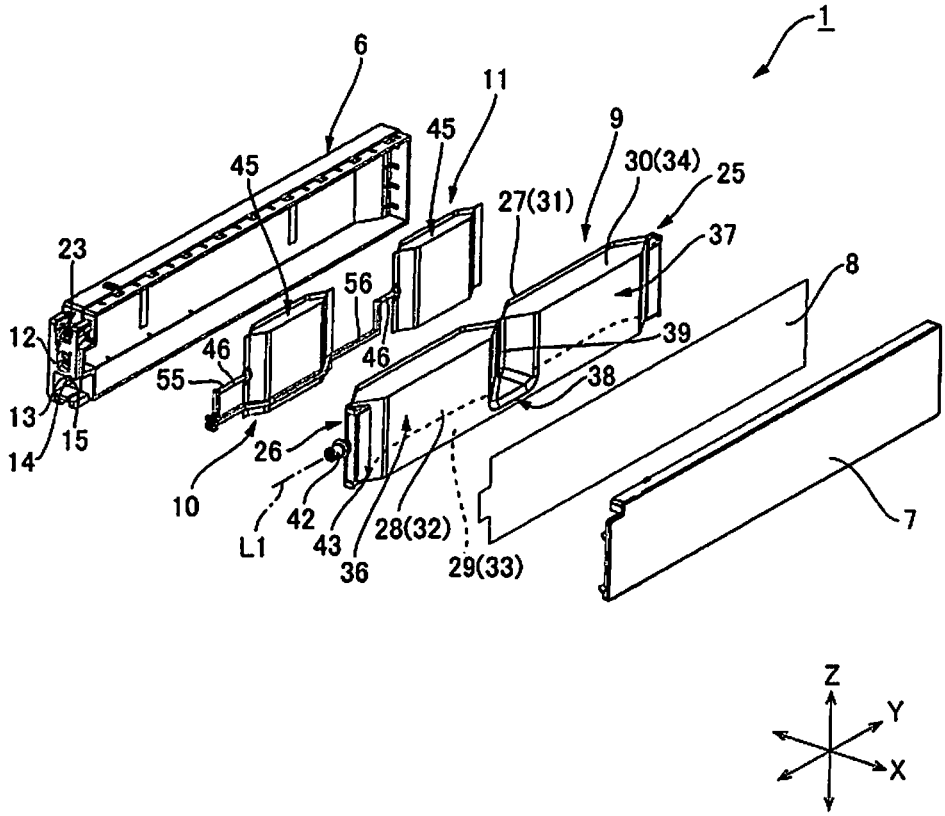
FIG. 2A is an exploded perspective view illustrating the cartridge of FIG. 1.
Figure 2B:
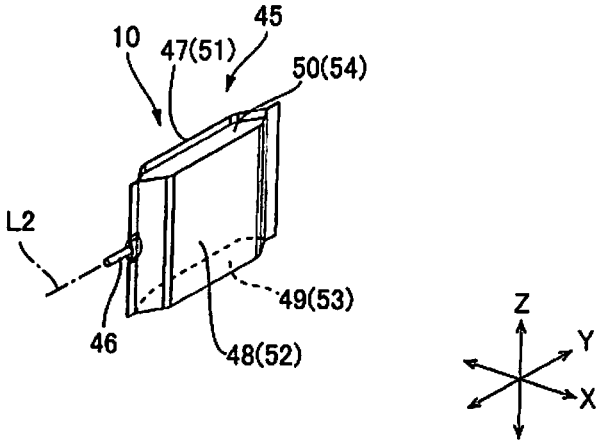
FIG. 2B is a perspective view illustrating an air bag.

FIG. 1A is an appearance perspective view illustrating a cartridge 1. FIG. 1B is a front view illustrating the cartridge 1. FIG. 2A is an exploded perspective view illustrating the cartridge 1. FIG. 2B is a perspective view illustrating an air bag.

The cartridge 1 is mounted to a mounting assembly 3 of an inkjet printer 2 to supply pigment ink to the inkjet printer 2. The attitude of the cartridge 1 shown in FIG. 1A is a mounting attitude in the process of mounting the cartridge 1 to the mounting assembly 3. In the description below, the left-right direction in the mounting attitude is referred to as width direction X of the cartridge 1. The mounting direction in which the cartridge 1 is mounted to the mounting assembly 3 is perpendicular to the width direction X and is referred to as front-rear direction or longitudinal direction Y of the cartridge 1. The vertical direction in the mounting attitude is referred to as vertical direction Z of the cartridge 1. The forward (front side) of the cartridge 1 denotes the forward (front side) in the mounting direction, and the rearward (rear side) denotes the opposite side in the mounting direction. The left side and the right side of the cartridge 1 denote the left side and the right side when the cartridge 1 is viewed from the front side.

As shown in FIG. 1A, the cartridge 1 includes a casing 5 in a rectangular parallelepiped shape. The casing 5 has shorter dimensions in width and in height than the dimension in length in the longitudinal direction Y. The casing 5 is also in a flat shape having the shorter dimension in width than the dimension in height. The casing 5 includes a box-like case main body 6 placed on the left side and a cover member 7 placed on the right side. The case main body 6 and the cover member 7 are made of a resin.

As shown in FIG. 2A, the case main body 6 has an opening facing to the right. The opening of the case main body 6 is closed by a film 8 that is thermally welded to an opening edge of the case main body 6. An ink pack (liquid container assembly) 9, a first air bag (pressing assembly) 10 and a second air bag (pressing assembly) 11 are placed in a space surrounded by the case main body 6 and the film 8. The ink pack 9 is located on the right side of the air bags 10 and 11. The first air bag 10 is located ahead of the second air bag 11. The cover member 7 is fixed to the case main body 6 such as to cover the film 8 from the right side.

As shown in FIG. 1B, an ink supply port (liquid supply port) 12, an air flow port for first air bag (fluid flow port for pressing assembly) 13, an air flow port for second air bag (fluid flow port for pressing assembly) 14, an air flow port for casing (fluid flow port for casing) 15 are formed on a front face 5*a* of the casing 5 (front face of the case main body 6). The air flow port for first air bag 13 and the air flow port for second air bag 14 are arrayed vertically. The air flow port for casing 15 is provided on the right side of the air flow port for first air bag 13 and the air flow port for second air bag 14. Positioning holes (positioning structures) 17 and 18 are provided such that the ink supply port 12, the air flow port for first air bag 13, the air flow port for second air bag 14 and the air flow port for casing 15 are placed between the positioning holes 17 and 18 in the vertical direction Z. The positioning hole 17 on the upper side 17 is a circular hole, and the positioning hole 18 on the lower side is a long hole extended in the vertical direction Z.

A substrate mounting structure 19 is provided in an upper end portion on the front face 5*a* of the casing 5. The substrate mounting structure 19 includes a substrate mounting surface 19*a* that is inclined downward toward the front. A memory substrate 23 on which a memory 21 and terminals 22 connecting with the memory 21 are mounted is fixed to the substrate mounting surface 19*a*. The memory 21 stores and holds information regarding, for example, the volume of ink filled in the ink pack 9 and the date of ink filling in the ink pack 9.

The ink contained in the ink pack 9 is pigment ink. The pigment ink includes particles of pigment dispersed in a solvent.

(Ink Pack)

As shown in FIG. 2A, the ink pack 9 includes a flexible ink containing bag 25 configured to contain the ink therein and an ink supply member 26 configured to supply the ink from the ink containing bag 25 to outside.

The ink containing bag 25 includes a first side face portion 27 located on the left side, a second side face portion 28 located on the right side, a lower gore portion 29 arranged to connect a lower end portion of the first side face portion 27 with a lower end portion of the second side face portion 28, and an upper gore portion 30 arranged to connect an upper end portion of the first side face portion 27 with an upper end portion of the second side face portion 28. The ink containing bag 25 is formed in a rectangular shape that is longer in the longitudinal direction Y as a planar shape by folding inward the upper gore portion 30 and the lower gore portion 29.

The ink containing bag 25 includes a first film 31 that forms the first side face portion 27, a second film 32 that forms the second side face portion 28, a third film 33 that forms the lower gore portion 29 and a fourth film 34 that forms the upper gore portion 30. The respective films 31 to 34 are joined to a bag-like shape having an opening facing to the front by welding adjacent edges of the respective films 31 to 34. Each of the films 31 to 34 is configured as a layered structure having a welding layer for joining and a composite barrier layer that includes a water content barrier layer and a gas barrier layer. The composite barrier layer includes, for example, the water barrier layer made from a resin film with an inorganic oxide depositing thereon and the gas barrier layer made of EVOH (ethylene-vinyl alcohol copolymer resin). The welding layer is made of, for example, PE (polyethylene) or CPP (unstretched polypropylene).

The ink containing bag 25 also includes a front containing bag portion 36 located on the front side, a rear containing bag portion 37 located on the rear side and a communicating portion 38 arranged to communicate the front containing bag portion 36 with the rear containing bag portion 37. The front containing bag portion 36, the rear containing bag portion 37 and the communicating portion 38 are parted from one another by providing a welded portion 39 in the middle in the longitudinal direction of the ink containing bag 25. The welded portion 39 is formed by welding predetermined lengths from the respective tops of the first film 31 and the second film 32 that are arranged to face each other in the width direction. The communicating portion 38 is accordingly configured to communicate a lower end portion of the front containing bag portion 36 with a lower end portion of the rear containing back portion 37.

The ink supply member 26 is attached to the front end of the ink containing bag 25. The ink supply member 26 includes an ink supply tube (container-side liquid supply tube) 42 serving as a flow passage of ink and a pair of left and right vertical plate portions 43. The ink supply tube 42 is inserted between a front edge of the first film 31 and a front edge of the second film 32 (opening of the ink containing bag 35) and is thermally welded to the first film 31 and the second film 32. The pair of vertical plate portions 43 are arranged on the respective sides in the width direction X to place the front edge of the first film 31 and the front edge of the second film 32 therebetween. The ink supply tube 42 has a center axis line L1 that is extended in the longitudinal direction Y (mounting direction). According to a modification, the ink supply member 26 used may include only the ink supply tube 42 with omission of the pair of left and right vertical plate portions 43. In this modified configuration, the ink supply tube 42 is also inserted between the front edge of the first film 31 and the front edge of the second film 32 (opening of the ink containing bag 35) and is thermally welded to the first film 31 and the second film 32.

The ink supply tube 42 is connected with the ink supply port 12 on the front face 5*a* of the casing 5. When the amount of ink contained in the ink pack 9 is reduced by supplying the ink through the ink supply tube 42 to the outside, the volume of the ink pack 9 is reduced by gradually folding inward the lower gore portion 29 and the upper gore portion 30.

(Air Bag)

Each of the first air bag 10 and the second air bag 11 includes a flexible air bag body 45 (vessel) configured to contain the air therein and an air flow tube 46 configured to introduce the air into the air bag body 45 and communicate the air bag body 45 with the atmosphere. Each of the air bags 10 and 11 has the dimension in length in the longitudinal direction Y that is not greater than half the dimension in length in the longitudinal direction Y of the ink pack 9. Each of the air bags 10 and 11 has the dimension in height that is equal to the dimension in height of the ink pack. The first air bag 10 comes in contact with the front containing bag portion 36 of the ink pack 9 from the left side of the ink pack 9. The second air bag 11 comes in contact with the rear containing bag portion 37 of the ink pack 9 from the left side of the ink pack 9. The first air bag 10 and the second air bag 11 have similar configurations. The following accordingly describes the configuration of only the first air bag 10 with omitting the description of the second air bag 11.

As shown in FIG. 2B, the air bag body 45 includes a first side face portion 47 located on the left side in the width direction X, a second side face portion 48 located on the right side, a lower gore portion 49 arranged to connect a lower end portion of the first side face portion 47 with a lower end portion of the second side face portion 48 and an upper gore portion 50 arranged to connect an upper end portion of the first side face portion 47 with an upper end portion of the second side face portion 48.

The air bag body 45 includes a first film 51 that forms the first side face portion 47, a second film 52 that forms the second side face portion 48, a third film 53 that forms the lower gore portion 49, and a fourth film 54 that forms the upper gore portion 50. The respective films 51 to 54 are joined to a bag-like shape having an opening facing to the front by welding adjacent edges of the respective films 51 to 54. The respective films 51 to 54 have a similar configuration to that of the respective films 31 to 34 included in the ink containing bag 25 of the ink pack 9.

The air flow tube 46 is attached to a front end portion of the air bag body 45. More specifically, the air flow tube 46 is inserted between the first film 51 and the second film 52 and is thermally welded to the first film 51 and the second film 52. The air flow tube 46 has a center axis line L2 that is extended in the longitudinal direction Y (mounting direction).

As shown in FIG. 2A, the air flow tube 46 of the first air bag 10 is connected with the air flow port for first air bag 13 on the front face 5*a* of the casing 5 via a first connecting tube 55. The air flow tube 46 of the second air bag 11 is connected with the air flow port for second air bag 14 on the front face 5*a* of the casing 5 via a second connecting tube 56.

(Mounting of Cartridge to Mounting Assembly)

Figure 3:
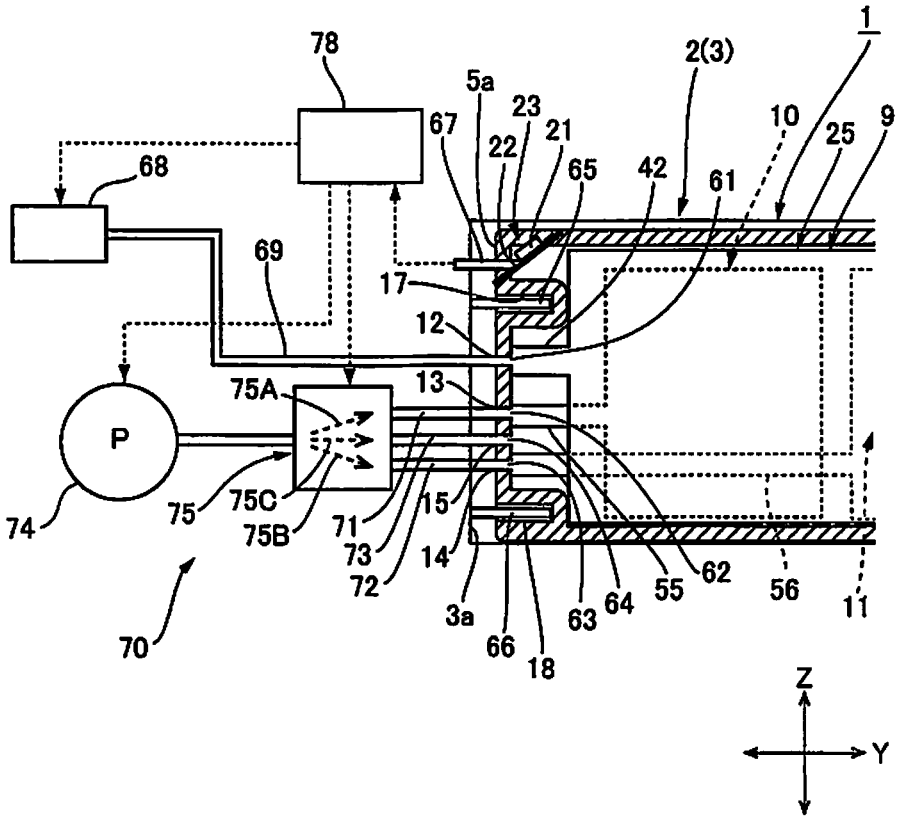
FIG. 3 is a diagram illustrating the state that the cartridge is mounted to an inkjet printer.

FIG. 3 is a diagram illustrating the state that the cartridge 1 is mounted to the mounting assembly 3 of the inkjet printer 2. The mounting assembly 3 of the inkjet printer 2 has an opposed face 3*a* that is arranged to face the front face 5*a* of the cartridge 1. The opposed face 3*a* is provided with an ink feed port 61, a mounting assembly-side first air flow port 62, a mounting assembly-side second air flow port 63 and a mounting assembly-side third air flow port 64 that are protruded from the opposed face 3*a*. The mounting assembly 3 also includes a pair of positioning pins 65 and 66 and a contact mechanism 67 provided on the opposed face 3*a*.

The ink feed port 61 is an upstream end of an ink supply passage 69 arranged to supply ink to an inkjet head 68. The mounting assembly-side first air flow port 62 is a downstream end of a first air flow passage 71 of an air supply mechanism 70 mounted on the inkjet printer 2. The mounting assembly-side second air flow port 63 is a downstream end of a second air flow passage 72 of the air supply mechanism 70. The mounting assembly-side third air flow port 64 is a downstream end of a third air flow passage 73 of the air supply mechanism 70. The pair of positioning pins 65 and 66 are arranged on the respective sides in the vertical direction Z to place the ink feed port 61, the mounting assembly-side first air flow port 62, the mounting assembly-side second air flow port 63 and the mounting assembly-side third air flow port 64 therebetween. The respective positioning pins 65 and 66 are protruded from the opposed face 3*a* in the mounting direction of the cartridge 1 (longitudinal direction Y).

The air supply mechanism 70 includes a pressurizing pump 74, the first air flow passage 71, the second air flow passage 72, the third air flow passage 73 and a selection valve 75. The pressurizing pump 74 is connected with upstream ends of the first air flow passage 71, the second air flow passage 72 and the third air flow passage 73. Upstream flow passage portions of the first air flow passage 71, the second air flow passage 72 and the third air flow passage 73 upstream of the selection valve 75 are joined and are connected with the pressurizing pump 74. The pressurizing pump 74 and the selection valve 75 are driven and controlled by a controller 78 of the inkjet printer 2 that controls the printing operation.

The selection valve 75 is configured such as to move its valve element among a first air flow passage selecting position 75A to select the first air flow passage 71, a second air flow passage selecting position 75B to select the second air flow passage 72 and a third air flow passage selecting position 75C to select the third air flow passage 73.

In the state that the valve element of the selection valve 75 is placed at the first air flow passage selecting position 75A, the pressurizing pump 74 communicates with the mounting assembly-side first air flow port 62. The mounting assembly-side second air flow port 63 and the mounting assembly-side third air flow port 64 are connected to the atmosphere via the selection valve 75. In the state that the valve element of the selection valve 75 is placed at the second air flow passage selecting position 75B, the pressurizing pump 74 communicates with the mounting assembly-side second air flow port 63. The mounting assembly-side first air flow port 62 and the mounting assembly-side third air flow port 64 are connected to the atmosphere via the selection valve 75. In the state that the valve element of the selection valve 75 is placed at the third air flow passage selecting position 75C, the pressurizing pump 74 communicates with the mounting assembly-side third air flow port 64. The mounting assembly-side first air flow port 62 and the mounting assembly-side second air flow port 63 are connected to the atmosphere via the selection valve 75.

In the process of mounting the cartridge 1 to the mounting assembly 3, the leading edges of the pair of positioning pins 65 and 66 are first inserted into the positioning holes 17 and 18 of the cartridge 1. This restricts the position of the cartridge 1 both in the vertical direction Z and in the width direction X. When the cartridge 1 is then pressed forward, the ink supply port 12 of the cartridge 1 is connected with the ink feed port 61. Simultaneously, the air flow port for first air bag 13 of the cartridge 1 is connected with the mounting assembly-side first air flow port 62, the air flow port for second air bag 14 is connected with the mounting assembly-side second air flow port 63, and the air flow port for casing 15 is connected with the mounting assembly-side third air flow port 64.

In the state that the cartridge 1 is mounted to the mounting assembly 3, the contact mechanism 67 electrically connects with the terminals 22 on the memory substrate 23. Such connection enables the controller 78 to read information from the memory 21 and write information into the memory 21.

(Ink Supply Operation and Ink Stirring Operation)

Figure 4A:
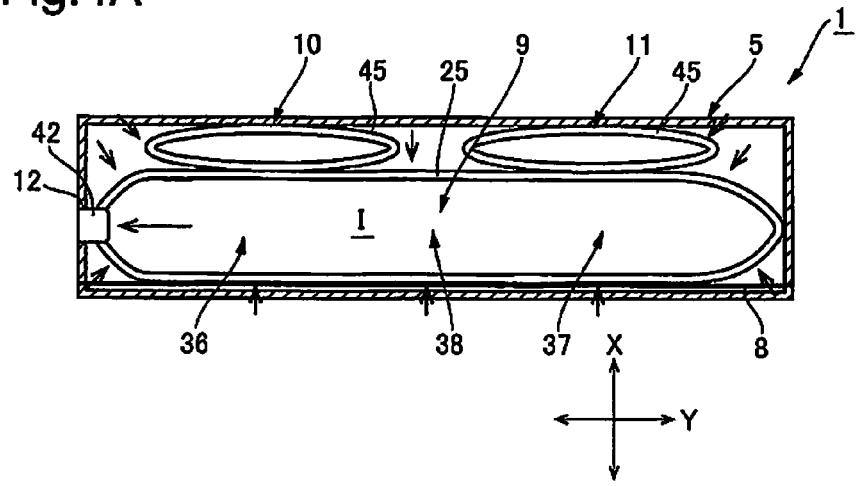
FIG. 4A is a diagram illustrating ink supply operation and ink stirring operation.
Figure 4B:
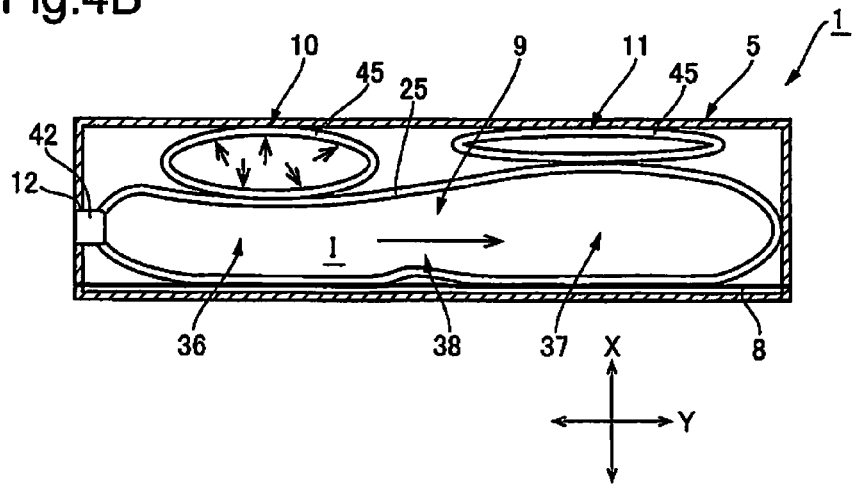
FIG. 4B is a diagram illustrating ink supply operation and ink stirring operation.
Figure 4C:
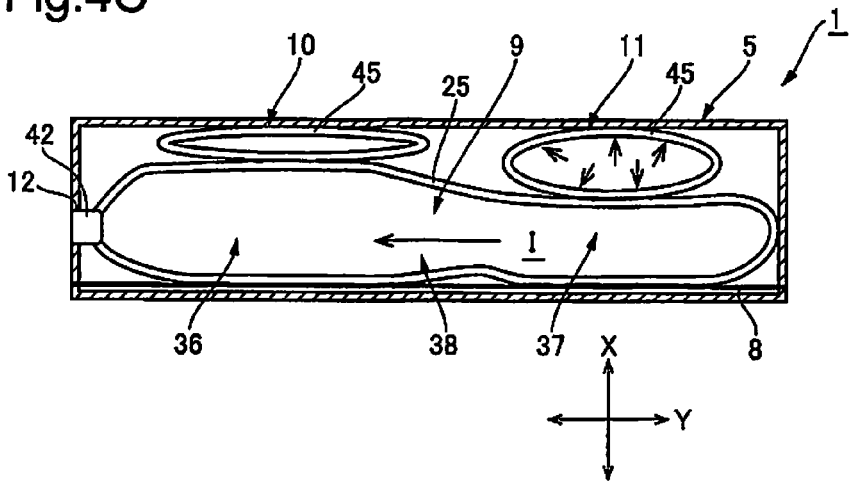
FIG. 4C is a diagram illustrating ink supply operation and ink stirring operation.

The following describes ink supply operation and ink stirring operation with reference to FIG. 3 and FIGS. 4A to 4C. FIGS. 4A to 4C are diagrams illustrating ink supply operation and ink stirring operation in the cartridge 1. FIGS. 4A to 4C show a section of the cartridge 1 taken along a plane perpendicular to the vertical direction Z. FIG. 4A illustrates the state that the pressurized air is introduced into the casing 5. FIG. 4B illustrates the state that the pressurized air is introduced into the first air bag 10. FIG. 4C illustrates the state that the pressurized air is introduced into the second air bag 11.

In the process of supplying ink I from the cartridge 1 to the inkjet printer 2 during a printing operation, the controller 78 drives the selection valve 75 to move its valve element to the third air flow passage selecting position 75C. More specifically, the controller 78 drives the selection valve 75 to communicate the pressurizing pump 74 with the mounting assembly-side third air flow port 64. The controller 78 then drives the pressurizing pump 74, so that the pressurized air is introduced from the third air flow passage 73 through the mounting assembly-side third air flow port 64 and the air flow port for casing 15 into the casing 5.

When the valve element of the selection valve 75 is placed at the third air flow passage selecting position 75C, the mounting assembly-side first air flow port 62 and the mounting assembly-side second air flow port 63 communicate with the atmosphere by means of the selection valve 75. The first air bag 10 and the second air bag 11 are accordingly open to the atmosphere.

When the pressurized air is introduced into the casing 5, the ink pack 9 is pressurized from the outside as shown by the arrows in FIG. 4A. Accordingly, the ink I in the ink containing bag 25 is supplied from the ink supply port 12 through the ink feed port 61 and the ink supply passage 69 of the mounting assembly 3 to the inkjet head 68.

On completion of printing, the controller 78 stops the pressurizing pump 74. The controller 78 also performs the ink stirring operation.

In the ink stirring operation, the controller 78 first drives the selection valve 75 to move its valve element from the third air flow passage selecting position 75C to the first air flow passage selecting position 75A. More specifically, the controller 78 drives the selection valve 75 to communicate the pressurizing pump 74 with the mounting assembly-side first air flow port 62. The controller 78 then drive the pressurizing pump 74, so that the pressurized air is introduced from the first air flow passage 71 through the mounting assembly-side first air flow port 62 and the air flow port for first air bag 13 into the first air bag 10.

When the valve element of the selection valve 75 is moved to the first air flow passage selecting position 75A, the mounting assembly-side second air flow port 63 and the mounting assembly-side third air flow port 64 communicate with the atmosphere by means of the selection valve 75. Accordingly the second air bag 11 and the casing 5 are open to the atmosphere. This reduces the internal pressure of the second air bag 11 and the internal pressure of the casing 5 and thus makes the second air bag 11 and the ink pack 9 likely to be deformed.

When the pressurized air is introduced into the first air bag 10, the air bag body 45 of the first air bag 10 is expanded to crush the front containing bag portion 36 of the ink pack 9 rightward as shown in FIG. 4B. This moves the ink I in the front containing bag portion 36 and thereby stirs the ink I in the front containing bag portion 36. When the front containing bag portion 36 is crushed, the ink I moves from the front containing bag portion 36 through the communicating portion 38 to the rear containing bag portion 37. This generates the convection flow of the ink I in the rear containing bag portion 37. This accordingly stirs the ink I in the rear containing bag portion 37.

The controller 78 subsequently drives the selection valve 75 to move its valve element from the first air flow passage selecting position 75A to the second air flow passage selecting position 75B. More specifically, the controller 78 drives the selection valve 75 to communicate the selection valve 75 with the mounting assembly-side second air flow port 63. The controller 78 then drives the pressurizing pump 74, so that the pressurized air is introduced from the second air flow passage 72 through the mounting assembly-side second air flow port 63 and the air flow port for second air bag 14 into the second air bag 11.

When the valve element of the selection valve 75 is moved to the second air flow passage selecting position 75B, the mounting assembly-side first air flow port 62 and the mounting assembly-side third air flow port 64 communicate with the atmosphere by means of the selection valve 75. Accordingly the first air bag 10 and the casing 5 are open to the atmosphere. This reduces the internal pressure of the first air bag 10 and the internal pressure of the casing 5 and thus makes the first air bag 10 and the ink pack 9 likely to be deformed.

When the pressurized air is introduced into the second-air bag 11, the air bag body 45 of the second air bag 11 is expanded to crush the rear containing bag portion 37 of the ink pack 9 rightward as shown in FIG. 4C. This moves the ink I in the rear containing bag portion 37 and thereby stirs the ink I in the rear containing bag portion 37. When the rear containing bag portion 37 is crushed, the ink I moves from the rear containing bag portion 37 through the communicating portion 38 to the front containing bag portion 36. This generates the convection flow of the ink I in the front containing bag portion 36. This accordingly stirs the ink I in the front containing bag portion 36.

The ink I is pigment ink. The pigment dispersed in the solvent is likely to deposit and precipitate in a lower portion of the ink pack 9. Such precipitation of the pigment causes concentration unevenness of the ink I in the ink pack 9.

Using the ink I of such concentration unevenness supplied to the inkjet printer 2 for printing is likely to cause the density unevenness in printing and deteriorate the printing quality.

The configuration of this embodiment, however, performs the ink stirring operation to alternately expand and contract the air bag body 45 of the first air bag 10 and the air bag body 45 of the second air bag 11 and thereby alternately expand and contract the ink pack 9 in the longitudinal direction Y. This deforms the ink pack 9 and moves the ink I in the ink pack 9 to stir the precipitating pigment. Accordingly this eliminates the concentration unevenness of the ink I (pigment ink) in the ink pack 9.

The configuration of this embodiment uses the single pressurizing pump 74 and the single selection valve 75 to supply the air to the first air bag 10 and the second air bag 11 and introduce the air to the casing 5. This simplifies the configuration of the inkjet printer 2 and reduces the manufacturing cost.

The ink stirring operation may be performed, for example, at the time of power supply to the inkjet printer 2. The timing and the frequency of the ink stirring operation may be set, based on the information, such as the date of ink filling, stored in the memory 21 of the memory substrate 23.

(Modifications)

Figure 5A:
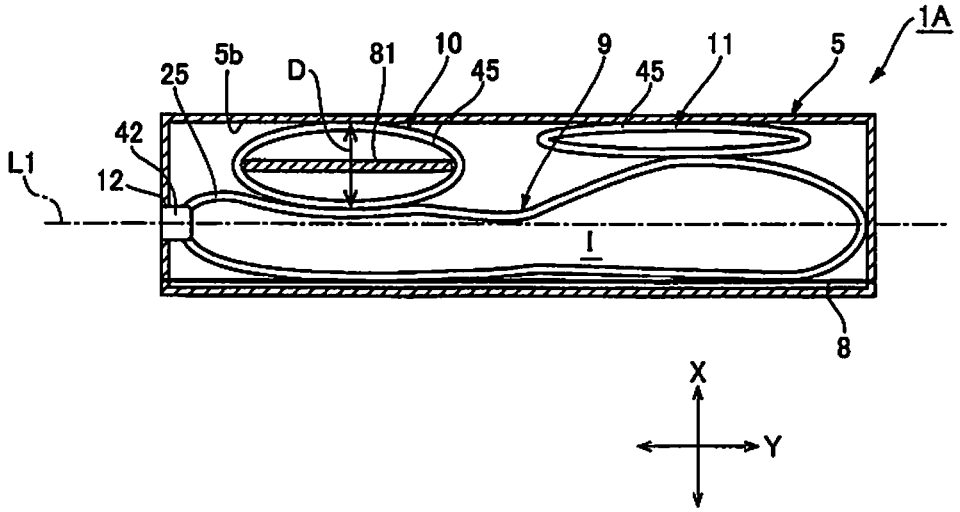
FIG. 5A is a diagram illustrating a cartridge of Modification 1.
Figure 5B:
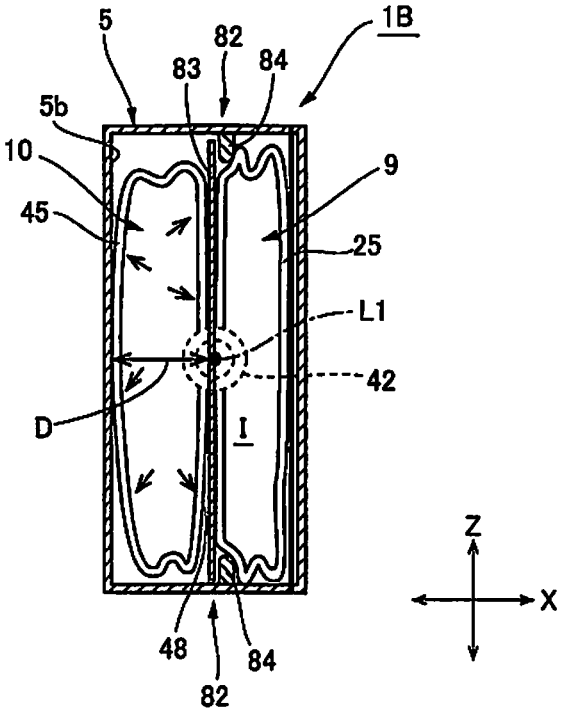
FIG. 5B is a diagram illustrating a cartridge of Modification 2.

FIG. 5A is a diagram illustrating a cartridge 1A of Modification 1 equipped with an expansion width control member that is configured to control the maximum expansion width of the first air bag 10. FIG. 5B is a diagram illustrating a cartridge 1B of Modification 2 equipped with an expansion width control mechanism that is configured to control the expansion width of the first air bag 10. FIG. 5A shows a section of the cartridge 1A taken along a plane perpendicular to the vertical direction Z. FIG. 5B shows a section of the cartridge 1B taken along a plane perpendicular to the longitudinal direction Y.

In the cartridge 1A of Modification 1 shown in FIG. 5A, the first air bag 10 is equipped with an expansion width control member that is configured to control the maximum width of expansion of the air bag body 45. The expansion width control member is a rectangular plate member 81 and is arranged inside of the air bag body 45 such that its thickness direction faces in the width direction X. When the air bag body 45 is expanded, the plate member 81 interferes with the air bag body 45 to control expansion of the air bag body 45 in the width direction X.

This configuration can regulate the pressing amount of the first air bag 10 that presses the ink pack 9 in the width direction X and thereby prevent an excessive displacement of the ink containing bag 25 relative to the ink supply tube 42. This configuration can thus prevent the welded portion of the ink containing bag 25 and the ink supply tube 42 from being broken even in the case of repetition of the ink stirring operation. This prevents ink from being leaked from the ink pack 9 due to the ink stirring operation. The second air bag 11 may be equipped with an expansion width control member like the first air bag 10.

The expansion width control member may serve to control a dimension D in width of the air bag body 45 in the state that the volume of the air bag body 45 is maximized by introduction of the air equal to or less than a distance between an inner surface (inner wall surface portion) 5*b* on a left side plate of the casing 5 and the axis line L1 of the ink supply tube 42 of the ink pack 9. This effectively prevents an excessive displacement of the ink containing bag 25 relative to the ink supply tube 42.

In the cartridge 1B of Modification 2 shown in FIG. 5B, the first air bag 10 is equipped with an expansion width control mechanism 82 that is configured to control the expansion width of the air bag body 45. The expansion width control mechanism 82 includes a plate member 83 that is attached to the second side face portion 48 of the first air bag 10 (side face portion on the ink pack 9-side), and a pair of protrusions 84 that are protruded inward from an upper plate portion and a lower plate portion of the casing 5. When the first air bag 10 is expanded in the width direction X by introduction of the air, the pair of protrusions 84 come in contact with the plate member 83 from the ink pack 9-side at a predetermined location in the width direction X and thereby interfere with further move of the plate member 83 toward the ink pack 9-side.

This configuration can regulate the pressing amount of the first air bag 10 that presses the ink pack 9 in the pressing direction X and thereby prevent an excessive displacement of the ink containing bag 25 relative to the ink supply tube 42. This configuration can thus prevent the welded portion of the ink containing bag 25 and the ink supply tube 42 from being broken even in the case of repetition of the ink stirring operation. This prevents ink from being leaked from the ink pack 9 due to the ink stirring operation. The second air bag 11 may be equipped with an expansion width control mechanism 82 like the first air bag 10.

The expansion width control mechanism 82 may serve to control a dimension D in width of the air bag body 45 in the state that the volume of the air bag body 45 is maximized by introduction of the air equal to or less than a distance between an inner surface (inner wall surface portion) 5*b* on a left side plate of the casing 5 and the axis line L1 of the ink supply tube 42 of the ink pack 9. This effectively prevents an excessive displacement of the ink containing bag 25 relative to the ink supply tube 42.

The first air bag 10 used may be configured such that the dimension D in width of the air bag body 45 in the state that the volume of the air bag body 45 is maximized by introduction of the air is equal to or less than the distance between the inner surface (inner wall surface portion) 5*b* on the left side plate of the casing 5 and the axis line L1 of the ink supply tube 42 of the ink pack 9. This effectively prevents an excessive displacement of the ink containing bag 25 relative to the ink supply tube 42.

(Other Embodiments)

The ink I is not limited to the pigment ink but includes any ink including particles, for example, dispersed dye ink.

The cartridge 1, 1A or 1B described above includes two air bags. The number of air bags may, however, be only one or may be three or more.

In the case where the ink pack 9 is inclined downward toward the front in the longitudinal direction Y (mounting direction) in the mounting attitude, only the first air bag 10 may be used as the air bag to sufficiently stir the ink. More specifically, in the case where the ink pack 9 is inclined downward toward the front, the pigment precipitates in a front portion (lower portion) of the ink containing bag 25 in the mounting attitude. The first air bag 10 pressing and deforming the front portion of the ink containing bag 25 stirs the portion of the ink pack 9 where the pigment is likely to be accumulated, thus effectively eliminating the concentration unevenness of the ink.

In the embodiment described above, the welded portion 39 serves to provide the front containing bag portion 36, the rear containing bag portion 37 and the communicating portion 38 of the ink containing bag 25. According to a modification, a rib protruded rightward may be provided on the inner surface 5*b* of the left side plate of the case main body 6. This rib may serve to partly crush downward the center in the longitudinal direction of the ink containing bag 25 and thereby provide the front containing bag portion 36, the rear containing bag portion 37 and the communicating portion 38 of the ink containing bag 25.

In the embodiment described above, the entire ink containing bag 25 of the ink pack 9 is made from the flexible film. According to a modification, the ink containing bag 25 may partly include a bag portion made of a rigid material. Similarly, the entire air bag bodies 45 of the air bags 10 and 11 are made from the flexible film. According to a modification, the air bag body 45 may partly include a bag portion made of a rigid material.

The above embodiment describes application of the invention to the cartridge 1 configured to contain the ink I that is to be supplied to the inkjet printer 2. The invention may also be applied to any of various cartridges that is configured to contain any of various liquids such as an electrode material or a color material (more specifically, a liquid prepared by dissolving an electrode material or a color material in a solvent) used for manufacturing, for example, liquid crystalline displays, EL displays and FED (field emission displays). The cartridge herein includes an adapter that is mounted to a liquid ejection apparatus and is configured to receive refill of a liquid from outside and supply the liquid to the liquid ejection apparatus.

What is claimed is:

1. A cartridge configured to be mounted to a liquid ejection apparatus including: a mounting assembly configured to connect to the cartridge; a liquid feed port configured to receive a liquid from the cartridge; and a head configured to eject the liquid, the cartridge comprising:

a liquid container assembly including a liquid container that is at least partly flexible and is configured to contain the liquid;

a pressing assembly including a vessel that is at least partly flexible and is configured to come in contact with the liquid container;

a casing that is configured to place the liquid container assembly and the pressing assembly therein;

a liquid supply port configured to supply the liquid from the liquid container assembly to the liquid ejection apparatus;

a first fluid flow port configured to introduce a fluid supplied from the liquid ejection apparatus into the vessel of the pressing assembly; and a second fluid flow port configured to introduce the fluid supplied from the liquid ejection apparatus into the casing, the liquid supply port, the first fluid flow port, and the second fluid flow port being provided on a front face of the casing in a mounting direction, and the front face of the casing facing the mounting assembly of the liquid ejection apparatus while the cartridge is mounted to the liquid ejection apparatus.

2. The cartridge according to claim 1, further comprising positioning structures that are provided on respective sides on the front face of the casing such as to place the liquid supply port, the first fluid flow port and the second fluid flow port therebetween and are configured to receive insertion of a pair of positioning pins of the liquid ejection apparatus so as to position the casing in a mounting process.

3. The cartridge according to claim 1, wherein the liquid container includes a front liquid container portion that is located on a front side in the mounting direction, a rear liquid container portion that is located on a rear side, and a communicating portion that is arranged to communicate the front liquid container portion with the rear liquid container portion, wherein the communicating portion is arranged to communicate a lower end portion of the front liquid container portion with a lower end portion of the rear liquid container portion in a mounting attitude.

4. The cartridge according to claim 1, wherein the liquid container is inclined downward toward front in the mounting direction in a mounting attitude, and the vessel is configured to come in contact with a front portion of the liquid container in the mounting direction.

5. The cartridge according to claim 1, wherein the liquid container assembly comprises a container-side liquid supply tube that is provided in a front end portion of the liquid container assembly in the mounting direction to supply the liquid from the liquid container to outside, wherein the container-side liquid supply tube is connected with the liquid supply port such that an axis line of the container-side liquid supply tube faces in the mounting direction, the vessel is placed between the liquid container and an inner wall surface portion of the casing that faces in a perpendicular direction that is perpendicular to the mounting direction, and a dimension in width of the vessel in the perpendicular direction in a state that a volume of the vessel is maximized by introduction of the fluid is equal to or less than a distance between the inner wall surface portion and the axis line.

6. The cartridge according to claim 1, wherein the pressing assembly comprises an expansion width control member that is placed in the vessel and is configured to interfere with the vessel and control a maximum width of expansion when the vessel is expanded.

7. The cartridge according to claim 1, further comprising an expansion width control mechanism that is configured to control an expansion width of the vessel, wherein the liquid container assembly comprises a container-side liquid supply tube provided in a front end portion of the liquid container assembly in the mounting direction to supply the liquid from the liquid container to outside, wherein the container-side liquid supply tube is connected with the liquid supply port such that an axial line of the container-side liquid supply tube faces in the mounting direction, the vessel is placed in a location adjacent to the liquid container in a perpendicular direction perpendicular to the mounting direction, and the expansion width control mechanism comprises a plate member that is attached to a portion of the vessel opposed to the liquid container, and a protrusion that is protruded inward from the casing to come in contact with the plate member from a liquid container side.

8. The cartridge according to claim 1, wherein the vessel is configured to receive the fluid whose pressure is higher than atmospheric pressure from the liquid ejection apparatus through the first fluid flow port and communicate with an atmosphere through the first fluid flow port while the fluid is not supplied from the liquid ejection apparatus.

9. A cartridge configured to be mounted to a liquid ejection apparatus including: a mounting assembly configured to connect to the cartridge; a liquid feed port configured to receive a liquid from the cartridge; and a head configured to eject the liquid, the cartridge comprising:

a liquid container assembly including a liquid container that is at least partly flexible and is configured to contain the liquid;

a pressing assembly including a vessel that is at least partly flexible and is configured to come in contact with the liquid container;

a casing that is configured to place the liquid container assembly and the pressing assembly therein, a liquid supply port configured to supply the liquid from the liquid container assembly to the liquid election apparatus;

a first fluid flow port configured to introduce a fluid supplied from the liquid ejection apparatus into the vessel of the pressing assembly; and a second fluid flow port configured to introduce the fluid supplied from the liquid ejection apparatus into the casing, the liquid supply port, the first fluid flow port, and the second fluid flow port being provided on a front face of the casing in a mounting direction, the pressing assembly including a plurality of pressing assemblies, and a plurality of the first fluid flow ports being provided corresponding to the respective pressing assemblies on the front face.

10. The cartridge according to claim 9, further comprising positioning structures that are provided on respective sides on the front face of the casing such as to place the liquid supply port, the first fluid flow port and the second fluid flow port therebetween and are configured to position the casing in a mounting process.

11. The cartridge according to claim 9, wherein the liquid container includes a front liquid container portion that is located on a front side in the mounting direction, a rear liquid container portion that is located on a rear side, and a communicating portion that is arranged to communicate the front liquid container portion with the rear liquid container portion, wherein the communicating portion is arranged to communicate a lower end portion of the front liquid container portion with a lower end portion of the rear liquid container portion in a mounting attitude.

12. The cartridge according to claim 9, wherein the liquid container is inclined downward toward front in the mounting direction in a mounting attitude, and the vessel is configured to come in contact with a front portion of the liquid container in the mounting direction.

13. The cartridge according to claim 9, wherein the liquid container assembly comprises a container-side liquid supply tube that is provided in a front end portion of the liquid container assembly in the mounting direction to supply the liquid from the liquid container to outside, wherein the container-side liquid supply tube is connected with the liquid supply port such that an axis line of the container-side liquid supply tube faces in the mounting direction, the vessel is placed between the liquid container and an inner wall surface portion of the casing that faces in a perpendicular direction that is perpendicular to the mounting direction, and a dimension in width of the vessel in the perpendicular direction in a state that a volume of the vessel is maximized by introduction of the fluid is equal to or less than a distance between the inner wall surface portion and the axis line.

14. The cartridge according to claim 9, wherein the pressing assembly comprises an expansion width control member that is placed in the vessel and is configured to interfere with the vessel and control a maximum width of expansion when the vessel is expanded.

15. The cartridge according to claim 9, further comprising an expansion width control mechanism that is configured to control an expansion width of the vessel, wherein the liquid container assembly comprises a container-side liquid supply tube provided in a front end portion of the liquid container assembly in the mounting direction to supply the liquid from the liquid container to outside, wherein the container-side liquid supply tube is connected with the liquid supply port such that an axial line of the container-side liquid supply tube faces in the mounting direction, the vessel is placed in a location adjacent to the liquid container in a perpendicular direction perpendicular to the mounting direction, and the expansion width control mechanism comprises a plate member that is attached to a portion of the vessel opposed to the liquid container, and a protrusion that is protruded inward from the casing to come in contact with the plate member from a liquid container side.

16. The cartridge according to claim 9, wherein the vessel is configured to receive the fluid whose pressure is higher than atmospheric pressure from the liquid ejection apparatus through the first fluid flow port and communicate with an atmosphere through the first fluid flow port while the fluid is not supplied from the liquid ejection apparatus.

* * * * *